United States Patent [19]

Harris

[11] Patent Number: 4,619,415

[45] Date of Patent: Oct. 28, 1986

[54] STRAND WINDING APPARATUS

[75] Inventor: Leslie J. Harris, Waterloo, Canada

[73] Assignee: Fiberglas Canada Inc., Toronto, Canada

[21] Appl. No.: 764,607

[22] Filed: Aug. 12, 1985

[30] Foreign Application Priority Data

Mar. 29, 1985 [CA] Canada ..... 477945

[51] Int. Cl.[4] ..... B65H 54/02; B65H 67/04

[52] U.S. Cl. ..... 242/18 G; 242/18 PW

[58] Field of Search ..... 242/18 G, 18 PW, 18 A, 242/18 EW, 18 R; 65/10.1, 11.1

[56] References Cited

U.S. PATENT DOCUMENTS

| | | | |
|---|---|---|---|
| 3,693,896 | 9/1972 | Brauweiler et al. | 242/18 A |
| 4,040,572 | 8/1977 | Melan | 242/18 G |
| 4,046,329 | 9/1977 | Eisenberg et al. | 242/18 G |
| 4,057,195 | 11/1977 | Jones et al. | 242/18 G |
| 4,208,016 | 6/1980 | Jones et al. | 242/18 G |
| 4,413,791 | 11/1983 | Kawaguchi et al. | 242/18 G |
| 4,511,095 | 4/1985 | Ideno et al. | 242/18 G |

*Primary Examiner*—Stanley N. Gilreath

*Attorney, Agent, or Firm*—Dennison, Meserole, Pollack & Scheiner

[57] ABSTRACT

An automatic strand winding apparatus is provided for use in a strand winding machine having a rotatable winding collet and a strand traversing mechanism for forming a package on the winding collet. The apparatus comprises a first strand engagement member mounted on a free end of the winding collet for rotation therewith into engagement with the strand and having fingers for catching the strand on rotation of the winding collet and thereby causing a first portion of the strand to become wound on the first strand engagement means, and a second strand engagement member for frictional engagement with the strand supported in an operational position adjacent and in alignment with the winding collet to cause a second portion of the strand to wind around and in frictionally engaged contact with the second strand engagement member, until breakage of the strand occurs in response to tension in the strand between the first and second strand engagement members.

23 Claims, 15 Drawing Figures

STRAND WINDING APPARATUS

FIELD OF THE INVENTION

The present invention relates to strand winding machines for winding strands of filaments attenuated from heat-softened mineral material, e.g. glass, and more particularly to an automatic strand winding apparatus for initiating the winding of the strand on such a strand winding machine.

DESCRIPTION OF THE PRIOR ART

A conventional strand winding machine comprises a winding collet which is rotated about a fixed horizontal axis for winding the strand around a collector tube fitted onto the collet, and a strand traverse mechanism for displacing the strand to and fro, parallel to the axis of rotation of the winding collet, as the strand approaches the winding collet, and thus causing the strand to be wound in a helical fashion into a package on the tube.

The heat-softened mineral material is provided by a bushing and is fed downwardly from the bushing across applicators, at which a size is applied to the filaments, and through gathering shoes and alignment combs. For attenuating the strand material prior to a winding operation, a pair of pull rolls are located to one side of the winding collet, and an operator standing on a floor above the strand winding machine manually guides the strand through a hole in the floor into engagement between the pull rolls, which are rotated in opposite directions to pull strand material therebetween.

At the beginning of a winding operation, another operator places the collector tube on the strand winding collet and initiates the winding of the strand on the collet by pulling the strand from the pull rolls, manually winding it around the winding collet and engaging it in the strand traversing mechanism, and this operator also breaks off waste strand, which is dumped below the strand winding machine.

In other words, this operator transfers the strand from a standby position, in which the strand is engaged in the pull rolls, to the winding collet.

Various attempts have, in the past, been made to automatically initiate the winding of the strand onto the winding collet.

For example, U.S. Pat. No. 3,693,896, issued Sept. 26, 1972, to Willhelm Brauweiler et al, shows a winding apparatus in which a glass strand is transferred from one winding drum to another winding drum by means of a cage having a plurality of parallel fingers and rotated in axial alignment with the first winding drum. A deflector bar is employed to transfer the strand from a wound package on the first winding drum onto the fingers of the cage, which is then withdrawn axially, rotated into axial alignment with the second winding drum and advanced axially thereto. The deflecting bar is then withdrawn, to allow the strand to be wound on the second winding drum.

While this prior apparatus is, thus, capable of transferring the strands from one winding drum to another, it cannot initiate the winding of a strand automatically from an idle or non-winding condition. Furthermore, this prior apparatus requires the provision of two winding drums or collets and, thus, the teachings of this prior patent cannot be applied to the above-described conventional strand winding machine.

U.S. Pat. No. 4,046,329, issued Sept. 6, 1977 to Arnold J. Eisenberg et al, teaches the use of a rotatably indexible turret carrying a pair of winding collets which, by rotation of the turret, can be brought in succession into a winding position. With this prior apparatus, when a package has been wound on a first one of the winding collets in the winding position, the turret is rotated to locate the second winding collet in the winding position, and the strand is then caught by a pin and groove arrangement at an end cap region of the second winding collet, which initiates winding of the strand around the second winding collet. The strand is then broken between the two winding collets by tension on the strand, and the completed package can then be removed manually from the first winding collet. This arrangement has the disadvantage that it cannot be employed to initiate automatic winding of the strand on either of the winding collets until the winding of the strand on one of those collets has been manually initiated. Therefore, the winding of the strand cannot be restarted automatically after a breakout.

There is also disclosed in FIGS. 15 and 16 of the aforementioned U.S. Pat. No. 4,046,329 a strand winding machine in which a strand is guided by means of a pair of pull rolls and a knock-off assembly past a winding collet end cap, which is provided with a peripheral groove and pin for engaging the strand to initiate the winding of the strand about the collet. This machine also has a second pair of pull rolls for retaining the strand at a spacing from the winding collet, but has no provision for transferring the strand from these second pull rolls into proximity to the winding collet end cap and, apparently, requires manual intervention for this purpose.

U.S. Pat. No. 4,040,572, issued Aug. 9, 1977 to Giuseppe-Fabrizio Mario Melan et al discloses another strand winding apparatus having a pair of winding collets indexibly mounted on a rotatable turret. In this case, an operator on a floor above the apparatus guides the strand into a pair of fixed pull rolls which are positioned directly below a winding position into which the winding collets can be moved in succession by rotation of the collet. Each of the collets is provided, at its free end, with a starting drum, which is formed on its face with a pair of diametrically opposed slots. A strand guide finger positioned above the winding position operates, in conjunction with the pull rolls, to press the strand against the face of the starting drum, so that the strand enters the slots and, by rotation of the winding collet in the winding position, is ruptured between that winding collet and the pull rolls and wound onto the winding collet.

This prior apparatus has the disadvantages that it requires the use of a pair of winding collets and a rotatable turret carrying such winding collets, and therefore is not applicable to the above-described conventional strand winding apparatus having a single winding collet rotatable about a fixed axis, and also that it requires the pull rolls to be visible to the operator at the floor above, which in some buildings may not be possible.

BRIEF SUMMARY OF THE INVENTION

It is accordingly an object of the present invention to provide novel and advantageous means for automatically initiating the winding of a strand onto a winding collet rotating about a fixed axis.

According to the present invention, there is provided automatic strand winding apparatus for use in a strand winding machine having a rotatable winding collet and means for traversing a strand to and fro along the winding collet to form a package on the winding collet, the strand winding apparatus comprises first strand engagement means adapted to be mounted on a free end of the winding collet for rotation therewith into engagement with the strand, the first strand engagement means having means for catching the strand on rotation of the winding collet and thereby causing a first portion of the strand to become wound on the first strand engagement means, second strand engagements means for frictional engagement with the strand, and means for supporting the second strand engagement means in an operational position adjacent the first strand engagement means and in alignment with the winding collet to cause a second portion of the strand to wind around and in frictionally engaged contact with the second strand engagement means during the winding of the first portion of the strand on the first strand engagement means until breakage of the strand occurs in response to tension in the strand between the first and second strand engagement means.

By appropriate dimensioning and shaping of the second strand engagement means, the frictional engagement of the strand therewith can be controlled in an optimum manner so as to ensure, for example, that overlying windings of the strand are built-up on the winding collet before the tension in the strand between the first and second strand engagement means becomes sufficiently large to cause the breakage of the strand.

Preferably, the strand catching means comprise fingers spaced around the first strand engagement means for engaging the strand, the fingers being directed in the direction of rotation of the first strand engagement means.

The present invention further provides a strand winding machine which comprises a winding collet, means for rotating the winding collet, means for traversing a strand to and fro along the winding collet during winding of the strand into a strand package on the winding collet, first strand engagement means mounted on a free end of the winding collet for rotation therewith, the first strand engagement means comprising means for catching the strand to initiate winding of the strand on the first strand engagement means, strand positioning means for displacing the strand to the first strand engagement means to enable the strand to be caught thereby, second strand engagement means for engaging a second portion of the caught strand, and means for supporting the second strand engagement means in an operational position adjacent the first strand engagement means and in alignment with said winding collet to cause the second portion of the caught strand to wind around and in frictionally engaged contact with the second strand engagement means during the winding of the first portion of said strand on the first strand engagement means until breakage of the strand occurs in response to tension in the strand between the first and second strand engagement means.

DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
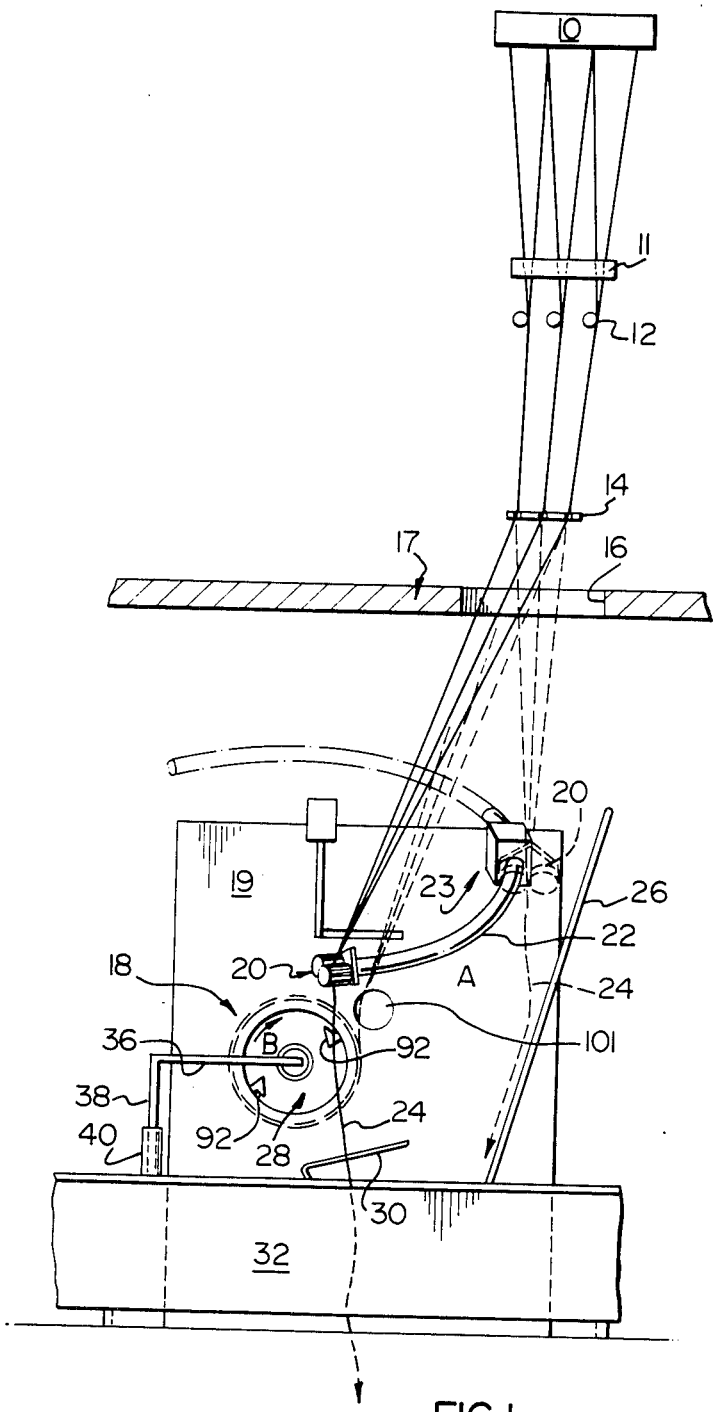
FIG. 1 shows a front view of a strand winding machine in accordance with one embodiment of the present invention.
Figure 2:
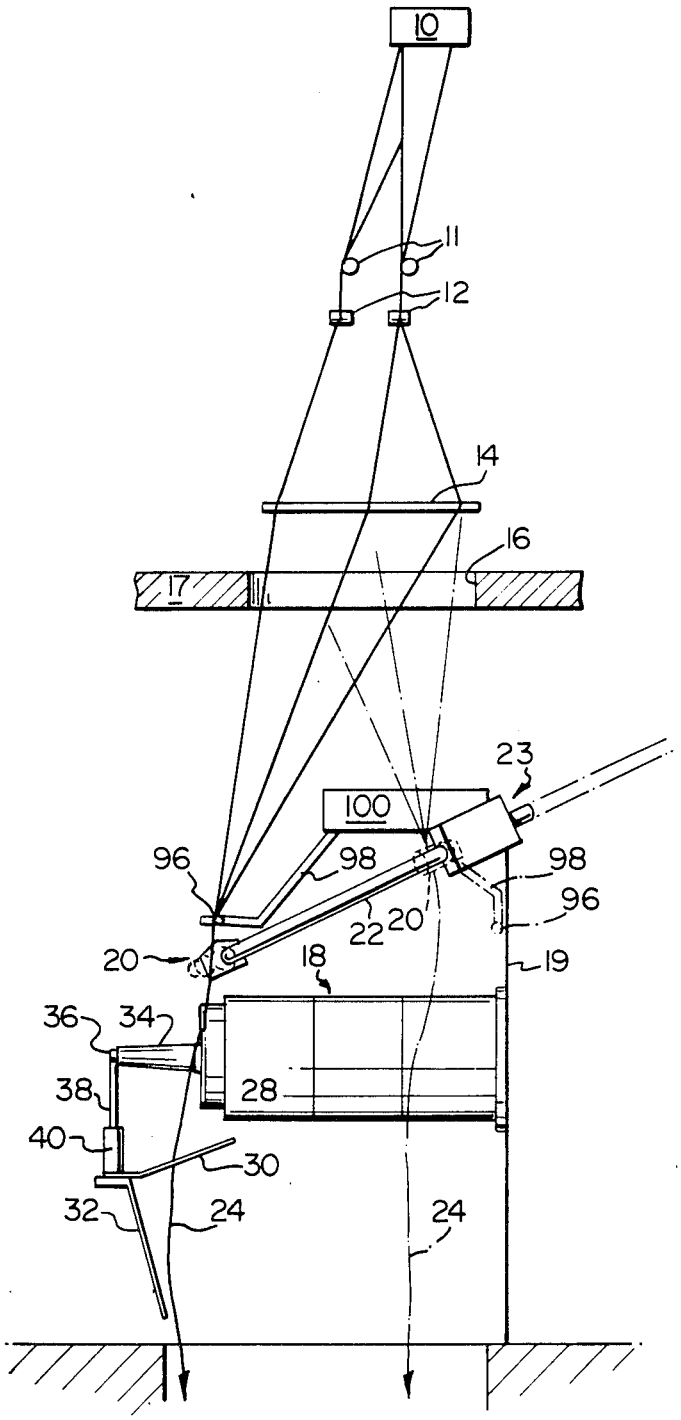
FIG. 2 shows a side view of the strand winding machine of FIG. 1.

The strand winding machine illustrated in FIGS. 1 and 2 of the accompanying drawings serves to wind a strand package from filaments formed in a feeder or bushing 10, which may be connected to receive molten glass from a glass melter or forehearth (not shown). The bushing 10 is provided in conventional manner with orifices (not shown) from which the filaments are attenuated and drawn downwardly over size applicators 11, at which a size is applied to the filaments, and past gathering shoes 12 and alignment combs 14, from which gathered and aligned groups of the filaments travel downwardly through an opening 16 in a floor 17 towards a winding collet indicated generally by reference numeral 18. The winding collet 18 is rotatable about its longitudinal, horizontal axis by a drive mechanism (not shown) accommodated within a housing 19 from which the winding collet 18 projects.

As thus far described, the strand forming machine is of conventional construction and operation.

In a conventional strand winding machine, it is usual to provide a pair of pull rolls, spaced laterally to one side of the winding collet, by which the groups of filaments are collected into a strand which passes between the pull rolls. The pull rolls are rotated so as to attenuate the filaments, the strand passing downwardly from the rpull rolls to a waste collection bin, pit or the like, located below the winding machine, prior to the initiation of a winding operation.

In the present machine, however, the filaments are attenuated and gathered into a strand by a pull roll assembly, indicated generally by reference numeral 20, which is mounted at a level above the winding collet and which, moreover, is movable to and fro, as described in greater detail hereinafter, to transfer the strand to and from the winding collet.

The pull roll assembly 20 is mounted on one end of a tube 22, which extends through a drive unit indicated generally by reference numeral 23 in FIG. 1. The drive unit 23 serves to longitudinally advance the tube to and fro for displacing the pull roll assembly between a wind-on position, in which the pull roll assembly 20 is shown in full lines in FIGS. 1, and a standby position, in which the pull roll assembly 20 is shown in broken lines in FIG. 1.

This movement of the tube 22 is indicated by a double-ended arrow A in FIG. 1.

When the pull roll assembly 20 is in the standby position prior to the winding of a package, the strand, indicated by reference numeral 24, travels downwardly from the pull roll assembly 20 to a guide plate 26, which guides the strand 24 downwardly to the waste collection pit below the strand winding machine.

When, however, the tube 22 is advanced by the drive unit 23 into the extended position, in which the tube 22 is shown in full lines in FIG. 1, the pull roll assembly 20 is located in a wind-on position above a first strand engagement member in the form of an end cap 28, which is mounted on a free end of the winding collet 18. The strand 24, traveling downwardly beyond the pull roll assembly 20, is guided by a guide bar 30 so as to pass in front of the latter and also to contact the periphery of the end cap 28.

A second strand engagement member 34 (FIG. 2) is supported so as to be coaxial with the strand winding collet 18 and extends forwardly from a position adjacent the end cap 28 to a support arm 36, which in turn extends traversely of the collet axis to a support post 38. The support post 38 is rotatably mounted in a sleeve 40 fixed to the shield 32 and, thus, the post 38 can be rotated in the sleeve 40 to swing the arm 36, and therewith the second strand engagement member 34, from the positions in which they are shown in full lines in FIGS. 1 and 2 through 180° to the positions in which they are removed to one side of the winding collet 18 to provide access to the latter for the removal of a wound package and for the fitting of a collector tube onto the winding collet 18 preparatory to the winding of a new package.

The construction of the strand transfer mechanism comprising the pull roll assembly 20, the tube 22 and the drive unit 23 will now be described in greater detail with reference to FIGS. 3, 3A, 4 and 4A.

The pull roll assembly 20 has two pull rolls 42 and 43, which have meshing longitudinal teeth 46 between which the strand 24 is engaged and driven and conical end portions 48 to facilitate insertion of the strand 24 between the pull rolls 42 and 43.

Figure 4:
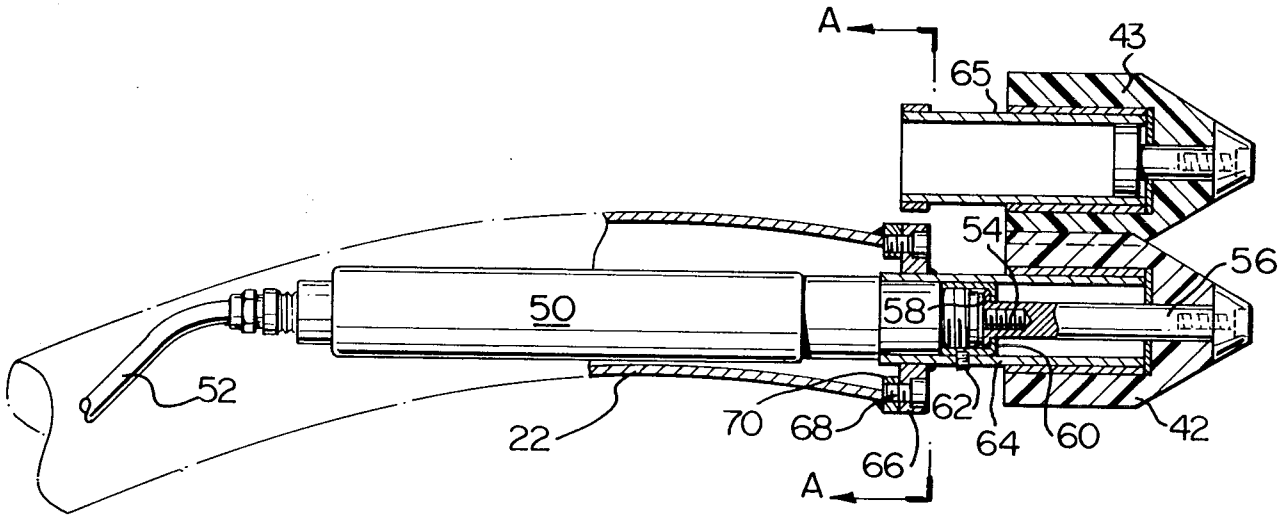
FIG. 4 shows a plan view taken in section through a pull roll assembly forming part of the strand transfer mechanism of FIG. 3.
Figure 4A:
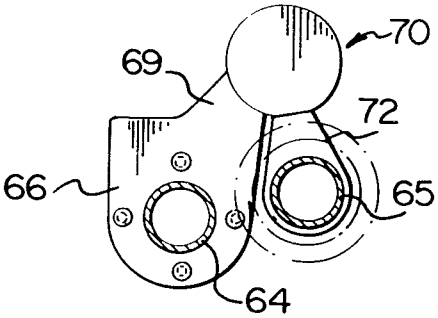
FIG. 4A shows a view in cross-section along the line A—A of FIG. 4.

As shown in FIG. 4, a pneumatic motor 50 mounted within one end of the tubular support member 22 and connected to an air hose 52 has an output shaft 54 in keyed engagement with a drive shaft 56 secured to the pull roll 42. The inner end of the drive shaft 56 is provided with a flange 58, which is retained by a cap 60 in threaded engagement with one end of the pneumatic motor 50, the cap 60 being secured by a grub screw 62 in threaded engagement with one of a pair of sleeves 64 and 65 rotatably supporting the pull rolls 42 and 43, respectively.

The sleeve 64 is welded to a plate 66 secured by screws 68 to a flange 70, which in turn is welded to the end of the tubular support member 22 and forms a closure for preventing the entry of contaminants into the end of the tubular support member 22.

The plate 66 is formed with an arm 69, which carries a spring housing 70 containing a spring (not shown) for biasing the pull roll 43 towards the pull roll 42, the pull roll 43 being freely rotatably mounted on the sleeve 65 and the sleeve 65 being welded to an arm 72 which extends into the spring housing and is resiliently urged towards the arm 69 by the spring. The provision of a pair of pull rolls which are spring-biased together in this way is well known to those skilled in the art and will therefore not be described in greater detail herein. It should be understood, however, that the present concept of displacing the pull rolls to and fro from a standby position, and the use of a tubular support member and drive unit for that purpose, are novel and do not form part of the prior art.

The tubular support member 22 is curved along its length and is supported by rollers 74, 75, **75*a*, 76, 77 and a further roller (not shown) which are journaled in roller support brackets 78 secured to a housing 80, which extends around the tubular support member 22. The rollers 75 and 76 are provided at the left-hand end of the housing 80, as viewed in FIG. 3, the rollers 74 and 77 being provided midway along the housing 80 and the roller 75*a* and the further roller (not shown) corresponding to the roller 76 being provided at the opposite end of the housing 80. An electric motor 82 mounted on the exterior of the housing drives a pulley 84, which is connected by a belt 85 to a pulley 86. The roller 77 and the pulley 86 are secured to a common shaft 88 so that the drive from the electric motor 82 is transmitted to the roller 77 and, thus, effects the longitudinal to and fro displacement of the tubular support member 22**.

Figure 3:
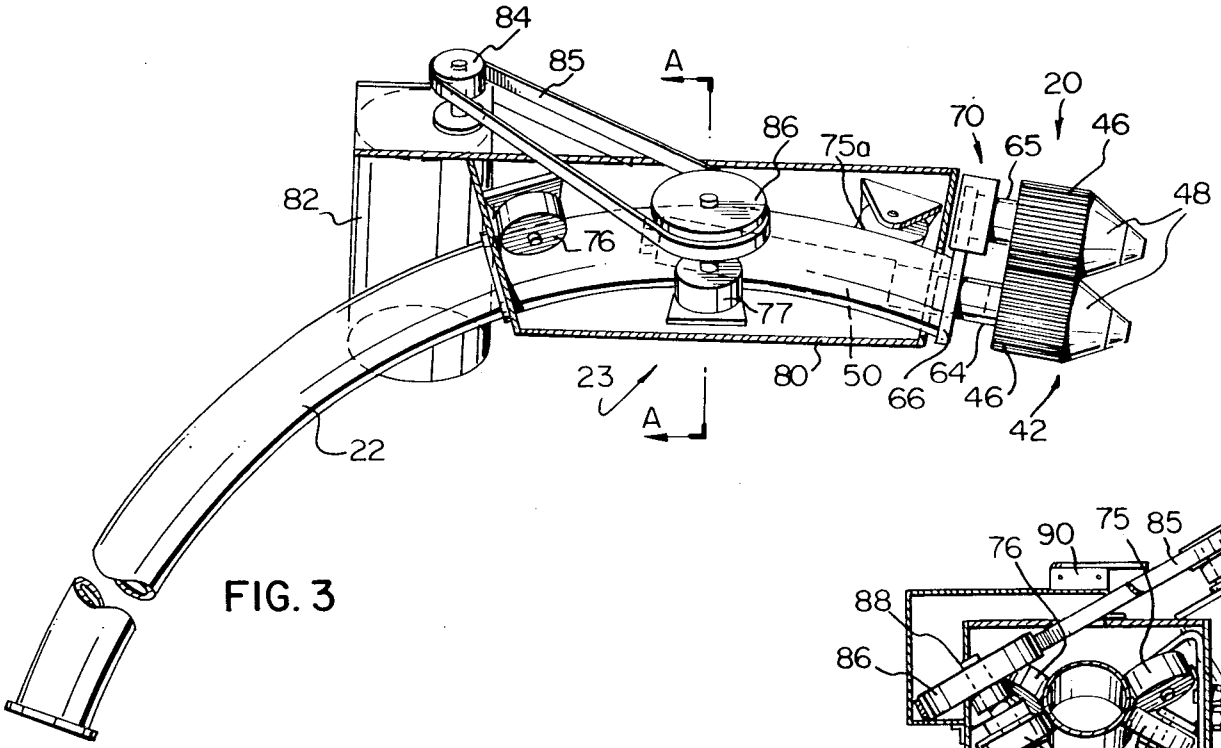
FIG. 3 shows a broken-away plan view, partly in section, of a strand transfer apparatus for automatically supplying a strand to and from a winding collet in the strand winding machine of FIGS. 1 and 2.
Figure 3A:
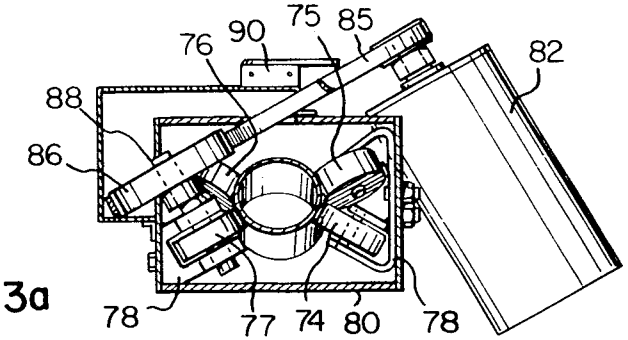
FIG. 3A shows a view taken in section along the line A—A of FIG. 3.

In FIG. 3, the pull roll assembly 20 is shown in the standby position, in which the pull roll assembly 20 is located adjacent one end of the housing 80. The tubular support member 22 is curved about an inclined axis. Consequently, the weight of the tubular support member 22 presses the member 22 against the rollers 74–77 to ensure a good frictional engagement and drive transmission between these rollers and the tubular support member. In addition, the housing 80 is mounted on a support bracket 90 at an inclination to the horizontal so that, as will be readily apparent from FIG. 1, the tubular support member 22 is downwardly inclined and, thus, the pull roll assembly 20, on movement from the standby position to the wind-on position, not only moves horizontally towards the winding collet but, in addition, moves downwardly from the drive unit 23 towards the winding collet 18 and also rotates somewhat about the inclined axis, which is the centre of curvature of the tubular support member 22.

As can also be seen from FIG. 1, the end cap 28 is provided with two fingers 92, which project in the direction of rotation of the winding collet 18 (indicated by an arrow B in FIG. 1) and which are formed by recesses intersecting the periphery and the front face of the end cap 28.

When the strand 24 is moved into contact with the end cap 28 by the advance of the pull roll assembly 20 from the standby position to the wind-on position, as described hereinabove, and by the guidance of the guide bar 30, the rotation of the winding collet 18 causes one of the fingers 92 to engage and entrain the strand 24.

This initiates the winding of the strand 24 onto the end cap 28, which will now be described with reference to FIGS. 5A to 5G.

Figures 5A, 5B, 5C, 5D:
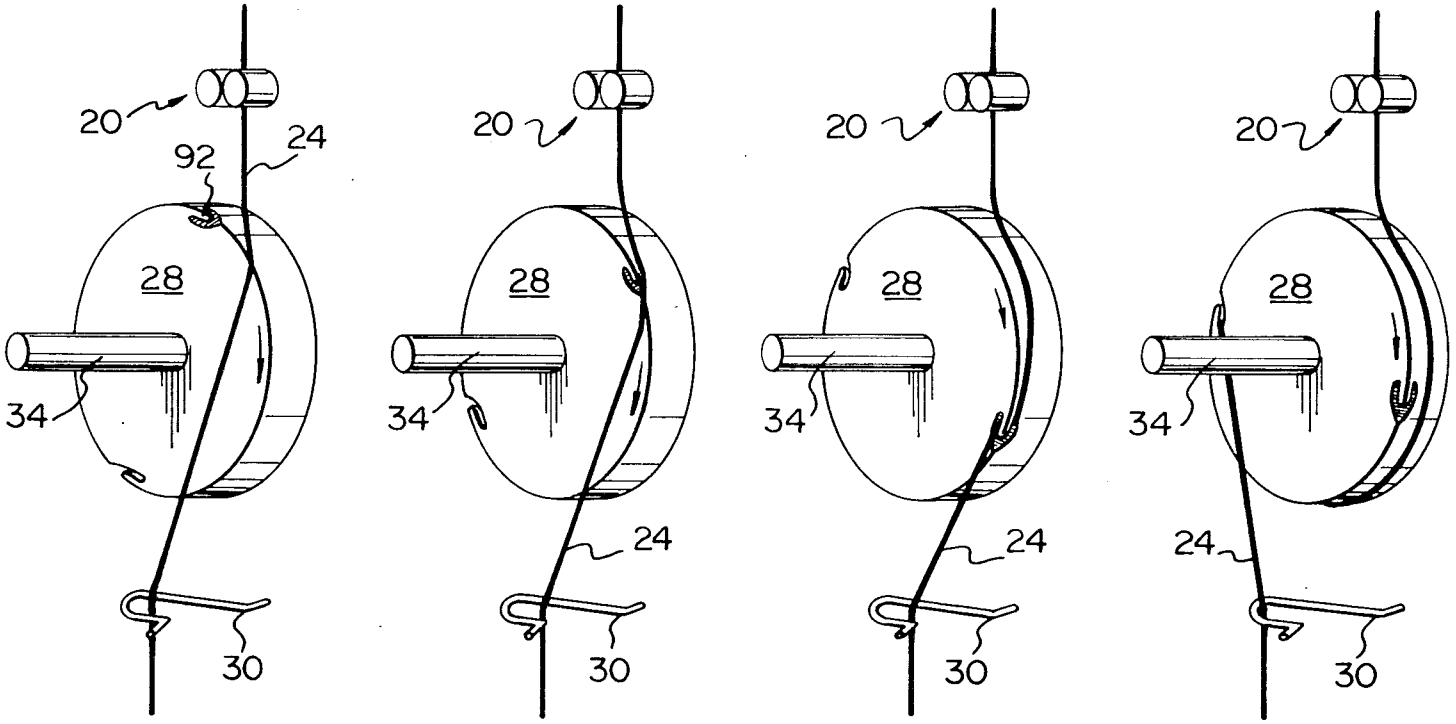
FIGS. 5A to 5G show diagrammatic views, in perspective, of successive steps in the engagement, winding and breaking of a strand by a strand wind-on assembly forming part of the strand winding machine of FIGS. 1 and 2.

FIG. 5A shows the position of the strand immediately before the strand is engaged by one of the fingers 92.

In FIG. 5B, the finger 92 is shown at the position at which it initially engages the strand 24. Rotation of the end cap 28 from the position in which it is shown in FIG. 5B to that of FIG. 5C initiates the winding of the strand 24 around the periphery of the end cap 28, and this winding is continued as shown in FIGS. 5D and 5E so that the portion of the strand beyond the finger 92 becomes wrapped around the second strand engagement member 34.

Further rotation of the end cap drags the strand around the second strand engagement member 34 and produces further turns of the strand around both the periphery of the end cap 28 and the second strand engagement member 34. The second strand engagement member 34 thus exerts on the strand material a frictional resistance against dragging of the strand material around the second strand engagement member 34, and this frictional resistance increases as the number of turns of the strand material around the second strand engagement member 34 increases. Eventually, this frictional resistance, and the consequential tension in the strand between the finger 92 and the second strand engagement member 34, increase to such an extent as to cause breakage of the strand, as illustrated in FIG. 5F, between the finger 92 and the second strand engagement member 34.

Figure 5G:
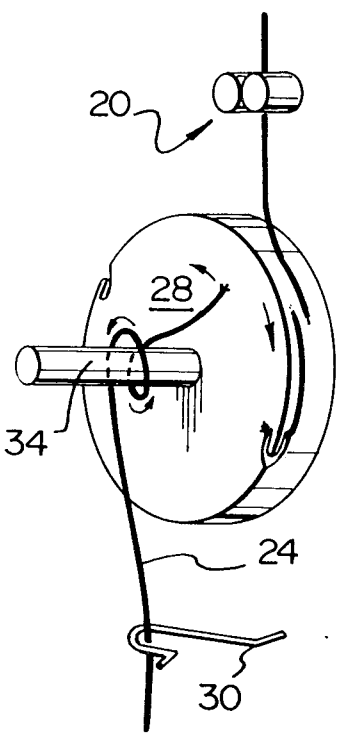
Figure 5F:
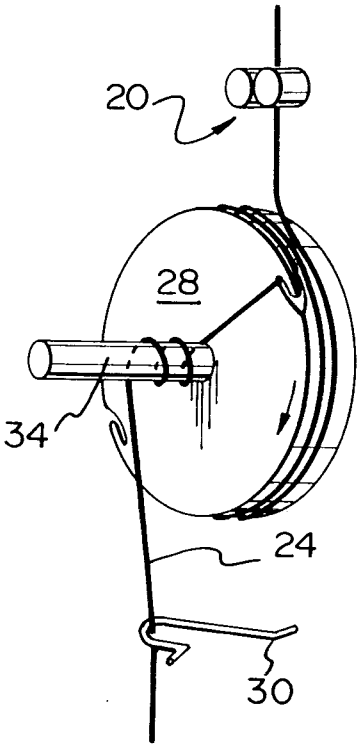
Figure 5E:
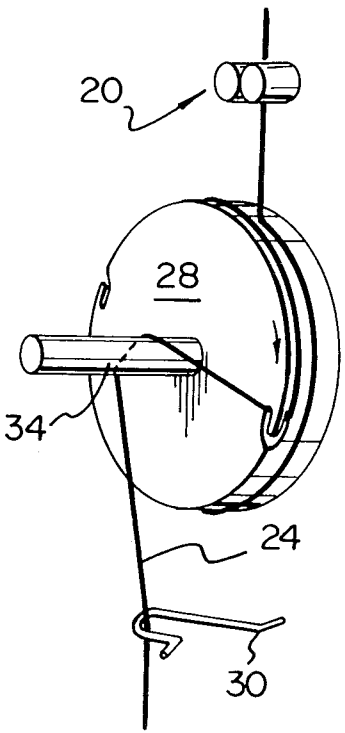

Although the turns of the strand 24 around the periphery of the end cap 28 have, for convenience, been shown as being disposed side-by-side in FIGS. 5E and 5F, it should be understood that, in practice, these turns are formed in overlying relationship, so that after the breakage of the strand mentioned above, the incoming strand material continues to be wound around the end cap.

However, the portion of the strand which remains wound around the second strand engagement member 34 is not disposed in overlying relationship. Furthermore, this strand has a certain resiliency, which is sufficient to cause the remnant of the strand to unwind itself automatically from the second strand engagement member 34, as shown in FIG. 5G, so that the strand remnant disengages itself from the second strand engagement member 34 and then drops downwardly into the strand waste collection pit.

As can be seen from FIG. 2, the second strand engagement member 34 has a shape which is tapered in a direction extending away from the end cap 28, and this tapered shape ensures that the turns of the strand which are wrapped around the second engagement member 34 slide away from the end cap 28 towards the narrower end of the strand engagement member 34 as they are formed and, thus, tend to be spaced apart along the strand engagement member 34 instead of being formed in overlying relationship.

Above the winding collet, there is provided a horizontally and transversely extending collector finger 96 at one end of a support arm 98 projecting downwardly from a collector housing 100. The arm 98 is pivotally mounted within the housing 100 and is connected to a pneumatic cylinder (not shown) in the housing 100, which cylinder is operable to pivot the arm 98, and therewith the collector finger 96, to and fro about a horizontal pivot axis between the position in which the arm 98 and the collector finger 96 are shown in full lines and the position at which they are shown in broken lines in FIG. 2.

In operation of the above-described apparatus, prior to the initiation of a winding operation the strand 24 and the pull roll assembly 20 are located in their standby positions, in which they are shown in broken lines in FIG. 1, so that the filaments leaving the bushing 10 are attenuated.

With the rotation of the winding collet 18 interrupted, the second strand engagement member 34 is moved away from the winding collet end cap 28, by rotation of the post 38 in the sleeve 40, to leave the winding collet 18 free for the operator of the machine to slip a collector tube onto the winding collet.

The second strand engagement member 34 is then moved into the operational position in which it is shown in FIG. 2 and the winding collet is rotated at a slow speed.

The pull roll assembly 20 is then moved from the standby position to the wind-on position in which it is shown in full lines in FIG. 1, carrying the strand 24 with it so that the strand passes over the front side, i.e. the side closest to the shield 32, of the strand guide 30 to the waste collection bin. One of the strand engagement fingers 92 then engages the strand 24 and starts the winding of the strand onto the end cap 28 and onto the second strand engagement member 34, as described hereinabove with reference to FIG. 5.

The pull roll assembly 20 is then retracted from the wind-up position to the standby position, and the strand is thereby transferred onto the collector finger 96, which at this time is located in the position in which it is shown in FIG. 2. When the winding collet 18 has been speeded-up to its desired winding speed, the collector finger 96 is pivoted to the right, as viewed in FIG. 2, to release the strand for winding into a package on the winding collet. During the winding operation, the strand is traversed along the winding collet in a conventional manner by a suitable strand traversing device, indicated by reference numeral 101 in FIG. 1, which may for example be a beater.

After the completion of the winding of the package, the speed of rotation of the winding collet 18 is reduced and the pull rolls 42 and 43 are again rotated and advanced from the standby position to the wind-on position, the movement of the pull rolls towards the wind-on position being synchronized with the speed reduction of the winding collet to ensure that, when the pull rolls arrive at the wind-on position, the winding collet is rotating the speed range within which the pull rolls can properly capture the strand. The collector finger 96 is displaced from the right to the left, as viewed in FIG. 2, to move the strand into the pick-up position of the pull rolls, which thus engage the strand. With the strand thus engaged, the collector finger 96 is retracted from the strand, i.e. moved to the right in FIG. 2, and by operation of the drive unit 23, the tubular support member 22 is then retracted, so that the pull roll assembly is withdrawn from the vicinity of the winding collet to the standby position.

The operator can then break the strand to enable the completed package to be removed from the winding collet and replaced by another collector tube, and then the automatic package winding cycle described above can be restarted.

Various modifications may be made, within the scope of the present invention, to the above-described embodiment. For example, while reference has been made above to only a single strand, it should be understood that the invention is readily applicable to the automatic winding of two, three or more packages simultaneously on one winding collet.

Figure 7:
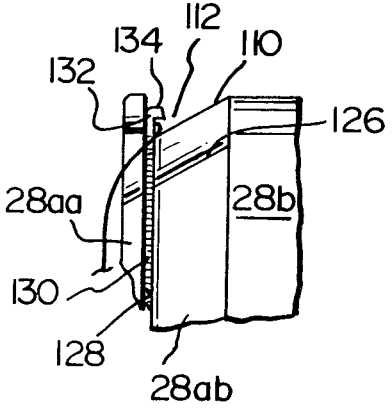
FIG. 7 shows a broken-away view taken in section along the line B—B of FIG. 6.
Figure 6:
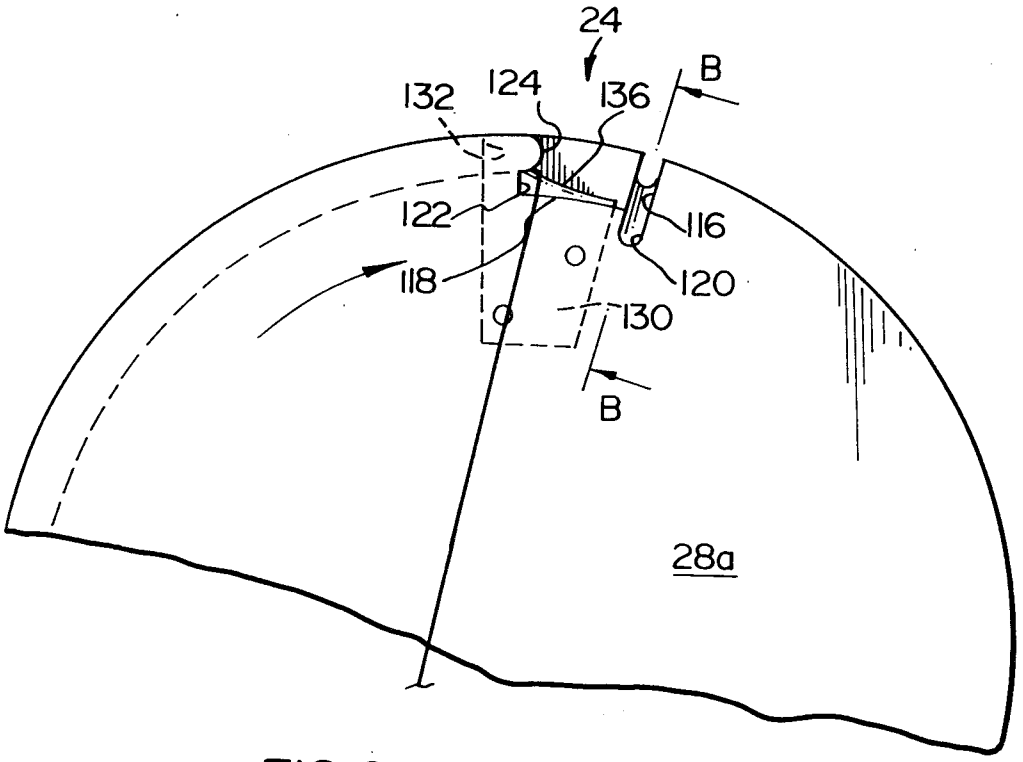
FIG. 6 shows a broken-away view in end elevation of a starting disc for use on the collet of the strand winding apparatus of FIG. 1.

FIGS. 6 and 7 show a starting disc **28*a* which is intended to be secured to an end cap 28*b* at the free end of the winding collet 18**, e.g. by screws (not shown).

As can be seen from FIG. 7, the starting disc 28*a* is formed of two disc parts 28*aa* and 28*ab* which are integral with one another.

The disc part 28*ab* is formed with a frustoconcial peripheral surface 110, which as viewed in side elevation is convergent towards the disc part 28*aa* and which, at the face of the disc part 28*ab* adjacent the disc part 28*aa*, has a diameter which is less than that of the disc part 28*aa*. Consequently, this peripheral surface 110 and the adjacent rear face of the disc part 28*ab* together define an annular peripheral notch 112 of triangular cross-section around the starting disc 28*a*.

The disc part 28*aa* is formed at three equiangularly spaced positions at its periphery, with recesses, of which only one is shown and is indicated generally by reference numeral 114.

Each recess 114 has a radial edge 116 at the leading end thereof, with respect to the direction of rotation of the disc 28*a*, which is indicated by an arrow in FIG. 6, an arcuate edge 118 concentric with the starting disc 28*a*, a U-shaped notch 120 between the arcuate edge 118 and the radial edge 116, and at the trailing end of the recess a radial edge 122 extending outwardly from the arcuate edge 118 to a semi-circular convex edge 124 extending to the periphery of the disc part 28*aa*.

The U-shaped notch 120 is provided at one end of a groove 126 extending through the periphery of the disc part 28*ab* in a direction which is convergent with the axis of the collet.

At each recess 114, the rear face of the disc part 28*aa* is formed with a rearwardly facing recess 128 for accommodating a finger plate 130 embedded in the starting disc 28*a*.

The finger plate 130 has a finger 132 which extends radially outwardly beyond the adjacent edge of the peripheral surface 110, as shown in FIG. 7, and is formed at its outermost end with a bent flange or edge portion 134 overlying and spaced radially outwardly from such edge of the peripheral surface 110 and spaced radially inwardly from the periphery of the disc part 28*aa*, the edge portion 134 thus projecting into the peripheral notch 112 at a spacing from the peripheral surface 110.

Adjacent the finger 132, finger plate 130 has an outer edge 136 which is curved rearwardly and outwardly towards the finger 132 and which is located radially outwardly of the arcuate edge 118 of the recess 114. This edge 136 is sharpened to serve as a strand cutting edge.

During operation of this modified strand wind-on assembly, the strand 24 is received into one of the three recesses 114 during the beginning of the strand wind-on operation. As the winding collet, the end plate 28*b* and the starting disc 28*a* rotate, the strand is carried around the guide bar 34 by the finger 132. This draws the strand against the cutting edge 136 on the finger plate 130 and thereby severs the strand.

The convex edge 124 serves to prevent an operator's finger from being caught and injured by the finger 132, and the groove 126 is provided to enable the operator to insert a knife edge between the starting disc 28*a* and strand wound on the starting disc 28*a* for cutting this strand at the end of a winding operation.

I claim:

1. Automatic strand winding apparatus for use in a strand winding machine having a rotatable winding collet and means for traversing a strand to and fro along said winding collet to form a package on said winding collet, said strand winding apparatus comprising:

a first strand engagement means adapted to be mounted on a free end of said winding collet for rotation therewith into engagement with said strand;

said first strand engagement means having means for catching said strand on rotation of said winding collet and thereby causing a first portion of said strand to become wound on said first strand engagement means;

second strand engagement means for frictional engagement with said strand; and means for supporting said second strand engagement means in an operational position adjacent said first strand engagement means and in alignment with said winding collet to cause a second portion of said strand to wind around and in frictionally engaged contact with said second strand engagement means during the winding of said first portion of said strand on said first strand engagement means until breakage of said strand occurs in response to tension in said strand between said first and second strand engagement means.

2. Automatic strand winding apparatus as claimed in claim 1, wherein said strand catching means comprise fingers spaced around said first strand engagement means for engaging said strand, said fingers being directed in the direction of rotation of said first strand engagement means.

3. Automatic strand winding apparatus as claimed in claim 2, wherein said first strand engagement means comprise an end plate for securement to said winding collet free end, said end plate having a cylindrical peripheral surface and a front face and said fingers being defined by recesses intersecting said peripheral surface and said front face.

4. Automatic strand winding apparatus as claimed in claim 1, wherein said second strand engagement means has a shape which tapers in a direction extending away from said first strand engagement means, when said second strand engagement means is supported in said operational position, to promote deflection of said second portion of said strand away from said first strand engagement means.

5. Automatic strand winding apparatus as claimed in claim 1, further comprising strand transfer means for transferring said strand from a strand standby position spaced from said winding collet to a strand wind-on position in which said strand is adjacent said first strand engagement means.

6. Automatic strand winding apparatus as claimed in claim 5, wherein said strand transfer means comprise a pair of pull rolls for attenuating said strand, first drive means for rotating said pull rolls, means for supporting said pull rolls for displacement to and fro between a pull roll standby position, in which said pull rolls locate said strand in said strand standby position, and a pull roll wind-on position, in which said pull rolls locate said strand in said strand wind-on position, and second drive means for displacing said pull rolls between said pull roll standby and wind-on positions.

7. Automatic strand winding apparatus as claimed in claim 6, wherein said support means comprise a tubular support member carrying said pull rolls at one end portion thereof, said first drive means are located within said end portion, means are provided for closing an outer end of said end portion to protect said first drive means from contamination and said second drive means comprises one of a plurality of rollers in guiding and rolling engagement with the exterior of said tubular support member and means for rotationally driving said one of said rollers.

8. Automatic strand winding apparatus as claimed in claim 7, wherein said tubular support member is longitudinally curved so as to pivot said pull rolls during the displacement of said pull rolls between said pull roll standby and wind-on positions.

9. Automatic strand winding apparatus as claimed in claim 1, wherein means are provided for engaging said strand with said strand traversing means after the winding of said first portion of said strand on said first strand engagement means.

10. A strand winding machine, comprising:

a winding collet;

means for rotating said winding collet;

means for traversing a strand to and fro along said winding collet during winding of the strand into a strand package on said winding collet;

first strand engagement means mounted on a free end of said winding collet for rotation therewith;

said first strand engagement means comprising means for catching said strand to initiate winding of said strand on said first strand engagement means;

strand positioning means for displacing said strand to said first strand engagement means to enable said strand to be caught thereby;

second strand engagement means for engaging a second portion of said caught strand; and means for supporting said second strand engagement means in an operational position adjacent said first strand engagement means and in alignment with said winding collet to cause said second portion of said caught strand to wind around and in frictionally engaged contact with said second strand engagement means during the winding of said first portion of said strand on said first strand engagement means until breakage of said strand occurs in response to tension in said strand between said first and second strand engagement means.

11. A strand winding machine as claimed in claim 10, wherein said strand positioning means comprise means for transferring said strand from a standby position spaced from said winding collet into engagement by said strand guide means.

12. A strand winding machine as claimed in claim 11, further comprising additional strand guide means below second strand engagement means for assisting the guidance of said strand against said first strand engagement means upon the transference of said strand from said standby position.

13. A strand winding machine as claimed in claim 10, wherein said support means comprises means supporting said second strand engagement means for movement between an operative position, in which said second strand engagement means is located adjacent said first strand engagement means, to an inoperative position in which said second strand engagement means is spaced from said first strand engagement means so as to permit removal of a finished package from said winding collet.

14. A strand winding machine as claimed in claim 11, further comprising means for displacing said strand along said winding collet and into engagement with said transferring means upon completion of a strand package, said transferring means being operable to return said strand to said standby position.

15. A strand winding machine as claimed in claim 11 wherein said transferring means comprise means for pulling said strand and means for displacing said pulling means to and fro between said standby position and a wind-on position located above said first strand engagement means.

16. A strand winding machine as claimed in claim 10, wherein said strand catching means comprise fingers spaced around said first strand engagement means for engaging said strand.

17. A strand winding machine as claimed in claim 16, wherein said first strand engagement means comprise an end cap secured to said winding collet free end, said end cap having a cylindrical peripheral surface and a front face and said fingers being defined by recesses intersecting said peripheral surface and said front face.

18. A strand winding machine as claimed in claim 10, wherein said second strand engagement means has a shape which tapers in a direction extending away from said first strand engagement means to promote deflection of said second portion of said strand away from said first strand engagement means.

19. A strand winding machine as claimed in claim 10, wherein said strand positioning means comprise means for guiding said strand along a path extending downwardly past said first and second strand engagement means and in contact with said first strand engagement means to cause said strand to be caught by said strand catching means, and strand transfer means for transferring said strand from a strand standby position spaced from said strand guide means to a strand wind-on position in which said strand is guided by said strand guide means along said path.

20. A strand winding machine as claimed in claim 19, wherein said strand transfer means comprise a pair of pull rolls for advancing said strand, first drive means for rotating said pull rolls, means for supporting said pull rolls for displacement to and fro between a pull roll standby position, in which said pull rolls locate said strand in said strand standby position, and a pull roll wind-on position, in which said pull rolls locate said strand in said strand wind-on position, and second drive means for displacing said pull rolls between said pull roll standby and wind-on positions.

21. A strand winding machine as claimed in claim 20, wherein said pull roll support means comprise a tubular support member carrying said pull rolls at one end portion thereof, said first drive means are located within said end portion, means are provided for closing an outer end of said end portion to protect said first drive means from contamination and said second drive means comprises one of a plurality of rollers in guiding and rolling engagement with the exterior of said tubular support member and means for rotationally driving said one of said rollers.

22. A strand winding machine as claimed in claim 21, wherein said tubular support member is longitudinally curved so as to pivot said pull rolls during the displacement of said pull rolls between said pull roll standby and wind-on positions.

23. A strand winding machine as claimed in claim 10, wherein means are provided for re-engaging said strand with said strand transferring means after the winding of a strand package on said winding collet, said strand transferring means being operable to return said strand to said strand standby position.

* * * * *